US008644741B2

(12) United States Patent
Hamada

(10) Patent No.: US 8,644,741 B2
(45) Date of Patent: Feb. 4, 2014

(54) DEVELOPING DEVICE AND IMAGE FORMING APPARATUS

(75) Inventor: Toshimasa Hamada, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 231 days.

(21) Appl. No.: 13/210,486

(22) Filed: Aug. 16, 2011

(65) Prior Publication Data

US 2012/0045255 A1 Feb. 23, 2012

(30) Foreign Application Priority Data

Aug. 20, 2010 (JP) ..... 2010-184570

(51) Int. Cl.
*G03G 15/08* (2006.01)
*G03G 21/00* (2006.01)

(52) U.S. Cl.
CPC ..... *G03G 15/08* (2013.01); *G03G 21/0011* (2013.01)
USPC ..... 399/284

(58) Field of Classification Search
USPC ..... 399/284
See application file for complete search history.

(56) References Cited

U.S. PATENT DOCUMENTS

| | | | | |
|---|---|---|---|---|
| 6,007,876 | A | 12/1999 | Niino | |
| 6,466,760 | B2 * | 10/2002 | Mizuno | 399/284 |
| 6,519,437 | B1 * | 2/2003 | Aoki et al. | 399/281 |
| 2007/0065185 | A1 | 3/2007 | Hasegawa et al. | |
| 2008/0205943 | A1 * | 8/2008 | Aimoto | 399/284 |
| 2009/0169273 | A1 * | 7/2009 | Anderson et al. | 399/284 |
| 2010/0183830 | A1 * | 7/2010 | Berbert | 428/34.8 |
| 2011/0183265 | A1 * | 7/2011 | Kim et al. | 430/296 |

FOREIGN PATENT DOCUMENTS

| | | | |
|---|---|---|---|
| CN | 101268422 | A | 9/2008 |
| JP | 06-149035 | | 5/1994 |
| JP | 11-052717 | A | 2/1999 |
| JP | 2000-187386 | | 7/2000 |
| JP | 11-209493 | | 11/2000 |
| JP | 2001-242701 | | 9/2001 |
| JP | 2005-316017 | A | 11/2005 |
| JP | 2006-259779 | | 9/2006 |
| JP | 2007-086238 | | 4/2007 |
| JP | 2007-094201 | A | 4/2007 |
| JP | 2010-091937 | A | 4/2010 |

OTHER PUBLICATIONS

Igarashi et al., "Hydrophilization of polydimetylsiloxane surface using glow discharge", 23rd meeting of research presentation of Hokkaido branch of Atomic Energy Society of Japan, 2005.

* cited by examiner

*Primary Examiner* — Walter L Lindsay, Jr.
*Assistant Examiner* — Philip Marcus T Fadul
(74) *Attorney, Agent, or Firm* — Renner, Otto, Boisselle & Sklar, LLP

(57) ABSTRACT

Provided is a developing device employing single-component development in which in an upstream side of a most proximate area of a developing roller and a blade for regulating a toner layer, toner aggregation is made difficult to occur between the developing roller and the blade, and uniformity of the toner layer on the developing roller is increased, so as to be able to perform development which does not apply heavy stress and is excellent in uniformity. In the developing device, the blade is divided into two areas of a downstream area in a rotational direction of the developing roller including the most proximate part to the developing roller and an upstream area in a rotational direction of the developing roller not including the most proximate part, and adhesion between a toner and the blade in the upstream area is made smaller than that in the downstream area.

20 Claims, 11 Drawing Sheets

DEVELOPING DEVICE AND IMAGE FORMING APPARATUS

CROSS-NOTING PARAGRAPH

This non-provisional application claims priority under 35 U.S.C. §119(a) on Patent Application No. 2010-184570 filed in JAPAN on Aug. 20, 2010, the entire contents of which are hereby incorporated herein by reference.

FIELD OF THE INVENTION

The present invention relates to a developing device employing single-component development which develops an electrostatic latent image formed on an electrostatic latent image carrier using a toner, and an image forming apparatus provided with the developing device.

BACKGROUND OF THE INVENTION

An electrophotographic image forming apparatus employs a developing method in which the surface of an electrostatic latent image carrier (for example, a photoreceptor) is charged and the charged area is exposed according to image information to form an electrostatic latent image, and the electrostatic latent image is developed and visualized (developed).

Such a developing method includes single-component development which uses only a toner without using a carrier as a developer.

An example of a conventional developing device employing single-component development will be described with reference to FIG. 13 and FIG. 14. FIG. 13 is a schematic view showing a state of a toner before passing through a toner layer regulating blade in a conventional developing device, and FIG. 14 is a schematic view showing a state where a toner is further aggregated compared to the state of FIG. 13.

The developing device mainly consists of a developing roller 3 for developing a toner to a photoreceptor, a supply roller 2 for supplying and removing the toner to and from the developing roller 3, and a toner layer regulating blade 5*k* for adding a charge amount while regulating the toner supplied from the supply roller 2 to the developing roller 3 to a predetermined amount. The blade 5*k* is configured such that a rubber member 5*q* such as urethane is attached to a tip of a metal plate 5*p*.

Here, for achieving high image quality, it is important to achieve an even toner layer on the developing roller 3 reaching a developing area.

A developing device described in Japanese Laid-Open Patent Publication No. 2000-187386 intends to stabilize an adhered amount and a charge amount of the toner layer on a developing roller after passing through a layer regulating blade by specifying an amount of intrusion of elastic rubber of the blade into the developing roller and a range of rubber hardness of the elastic rubber of the blade.

In the developing device described in Japanese Laid-Open Patent Publication No. 2000-187386, an amount of intrusion of the elastic rubber is reduced and the rubber hardness is decreased, so that a load on a toner is reduced to suppress deterioration of the toner.

In order to secure the charge amount of the toner, however, not less than a certain amount of intrusion of the elastic rubber and not less than certain rubber hardness are necessary, and it is difficult to realize securing of the charge amount and suppression of toner deterioration only by optimizing them.

The causes of the toner deterioration include that the blade presses the toner in a most proximate area of the blade and the developing roller and that the supply roller contacts with the developing roller and a load is applied to the toner when supplying the toner to the developing roller, whereas, in addition, the toner is deteriorated from the cause that the toner between the developing roller and the blade does not move and is gradually applied with pressure to aggregate in an upstream side of the most proximate area of the blade and the developing roller.

To describe the example of FIG. 13, although the toner that moved up on the developing roller 3 as shown by an arrow of solid line passes through the blade 5*k* to be regulated to a certain toner amount, a certain amount of the toner stagnates before passing through the blade. The stagnated portion is necessary for stabilizing the adhered amount of the toner after passing through the blade, but the toner gradually aggregates and stops moving because the toner is moved up continuously and is therefore subject to a compressing force. In addition, at this time, the toner that moved up collides with an aggregated toner Tc and a part of the toner is returned as shown by an arrow of dotted line, but the toner prominently aggregates due to this collision. Then, as shown in FIG. 14, a wide aggregation area Tz is formed as getting on a toner T which is below an averaged toner surface depicted by dotted straight line.

In this manner, when the toner aggregates in the area before passing through the blade, the toner capable of involving in the blade passing is reduced, and thereby the toner layer is not stabilized as well as toner deterioration due to the aggregation is advanced.

SUMMARY OF THE INVENTION

An object of the present invention is to provide a developing device employing single-component development which is able to make it difficult for a toner to aggregate between the developing roller and the blade in an upstream side of a most proximate area of a developing roller and a blade for regulating a toner layer, to increase uniformity of the toner layer on the developing roller, and to perform development which does not apply heavy stress and is excellent in uniformity, and an image forming apparatus provided with the developing device.

A first technical means of the present invention is a developing device employing single-component development having a developing roller and a blade for regulating a toner layer, applying a bias voltage to the developing roller and developing an electrostatic latent image formed on an electrostatic latent image carrier using a toner, wherein the blade is divided into two areas of a downstream area in a rotational direction of the developing roller including a most proximate part to the developing roller and an upstream area in a rotational direction of the developing roller not including the most proximate part, and adhesion between a toner and the blade in the upstream area is made smaller than that in the downstream area.

A second technical means is the developing device of the first technical means, wherein the blade has higher hydrophilicity on a surface of the upstream area than that of a surface of the downstream area so that adhesion between the toner and the blade in the upstream area is made smaller than that in the downstream area.

A third technical means is the developing device of the second technical means, wherein the blade uses a same material for the upstream area and the downstream area, and differentiates a surface treatment between the upstream area and the downstream area to differentiate hydrophilicity.

A fourth technical means is the developing device of the third technical means, wherein the blade is subjected to a plasma surface treatment with the downstream area masked to differentiate hydrophilicity of the only upstream area.

A fifth technical means is the developing device of the third technical means, wherein the blade is subjected to a corona discharge treatment with the downstream area masked to differentiate hydrophilicity of the only upstream area.

A sixth technical means is the developing device of the third technical means, wherein the blade irradiates only the upstream area with excimer laser light to differentiate hydrophilicity of the only upstream area.

A seventh technical means is the developing device of the second technical means, wherein the blade uses a material having different hydrophilicity for the upstream area and the downstream area so that the upstream area has higher hydrophilicity.

An eighth technical means is the developing device of the first technical means, wherein the blade has smaller surface roughness in the upstream area than that in the downstream area, so that adhesion between the toner and the blade in the upstream area is made smaller than that in the downstream area.

A ninth technical means is the developing device of the first technical means, wherein the blade has larger thickness in the upstream area than that in the downstream area.

A tenth technical means is the developing device of the first technical means, wherein an auxiliary rotatable member is arranged at a position proximate to the developing roller between a part where the developing roller is proximate to the blade and a part where the developing roller contacts with a supply roller for supplying a toner to the developing roller, so that the auxiliary rotatable member rotates in an opposite direction from the developing roller.

An eleventh technical means is the developing device of the tenth technical means, wherein surface roughness of the auxiliary rotatable member is larger than that of the upstream area of the blade.

A twentieth technical means is the developing device of the tenth technical means, wherein the auxiliary rotatable member is a metal roller.

A thirteenth technical means is the developing device of the tenth technical means, wherein a groove is formed on a surface of the auxiliary rotatable member.

A fourteenth technical means is the developing device of the tenth technical means, wherein the auxiliary rotatable member has a plurality of blades vertical to a rotational axis.

A fifteenth technical means is the developing device of the tenth technical means, wherein when a developing step is finished, the auxiliary rotatable member stops after a certain period of time after the developing roller stops.

A sixteenth technical means is an image forming apparatus provided with the developing device of the first technical means.

PREFERRED EMBODIMENTS OF THE INVENTION

Figure 1:
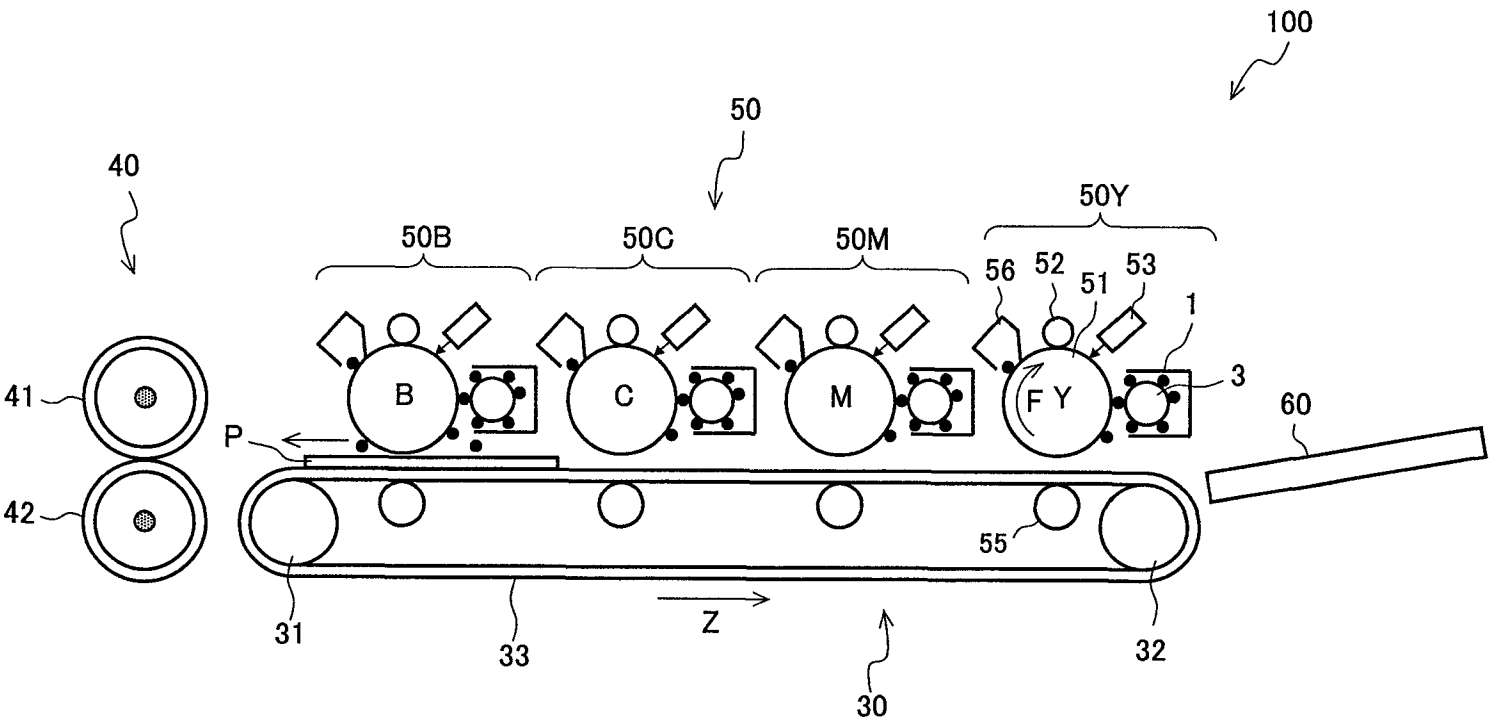
FIG. 1 is a schematic view showing an exemplary configuration of an image forming apparatus according to the present invention.

Each embodiment of the present invention will hereinafter be described in detail with reference to drawings. Note that, in this specification and drawings, the components having substantially the same functional configurations are denoted by the same reference numerals so that repeated description will be omitted.

First, for an exemplary configuration of an image forming apparatus according to the present invention will be described. FIG. 1 is a schematic view showing an exemplary configuration of an image forming apparatus according to the present invention. Note that, an image forming apparatus 100 shown in FIG. 1 is an example described mainly with principal components in a simplified manner.

The image forming apparatus 100 is provided with a plurality of photoreceptors 51 for serving as electrostatic latent image carrier, and is provided with four photoreceptors for yellow images, magenta images, cyan images, and black images in this exemplary configuration. That is, the image forming apparatus 100 illustrated in FIG. 1 is a tandem-type color image forming apparatus capable of forming a color image. The image forming apparatus 100 has a printer function to form a color image or a monochrome image on a sheet P for serving as a transfer receiving member (recording medium) based on image data transmitted from various kinds of terminal apparatuses such as a PC (Personal Computer) connected through a network or image data read by a document reading apparatus such as a scanner.

As shown in FIG. 1, the image forming apparatus 100 is provided with an image forming station portion 50 (50Y, 50M, 50C, 50B) that has a function to form a toner image on the sheet P, a fixing device 40 that has a function to fit the toner image formed on the sheet P by the image forming station portion 50, and a transport portion 30 that has a function to transport the sheet P from a feed tray 60 on which the sheet P is placed to the image forming station portion 50 and the fixing device 40.

The image forming station portion 50 is comprised of four image forming stations 50Y, 50M, 500, and 50B for yellow images, magenta images, cyan images, and black images, respectively. Specifically, the yellow image forming station 50Y, the magenta image forming station 50M, the cyan image forming station 50C, and the black image forming station 50B are arranged in this order from the side of the feed tray 60 between the feed tray 60 and the fixing device 40.

The image forming stations 50Y, 50M, 50C, and 50B for the respective colors have substantially the same configuration except for the type of the toner, and form yellow, magenta, cyan, and black toner images according to image data corresponding to the respective colors so that the toner images are eventually transferred onto the sheet P for serving as the recording medium.

The image forming station portion 50 in this exemplary configuration has a configuration to form images in four colors of yellow, magenta, cyan, and black, but may have a configuration to form toner images in six colors additionally including, for example, light cyan (LC) and light magenta (Lm) that have the same color hues as cyan and magenta and have a lower density, without particular limitation to the four colors.

Note that, in FIG. 1, the components of the respective image forming stations are shown with alphanumeric references on the yellow image forming station 50Y as a representative, and the alphanumeric references of the components of the other image forming stations 50M, 50C, and 50B are omitted.

Each of the image forming stations 50Y, 50M, 50C, and 50B is respectively provided with the photoreceptor 51 for serving as a latent image carrier on which an electrostatic latent image is formed, and a charging device 52, an exposure device 53, a developing device 1, a transfer roller 55, and a cleaning device 56 are arranged in the circumferential direction around each of the photoreceptors 51.

The photoreceptor 51 is in the shape of a substantially cylindrical drum on the surface of which a photosensitive material such as an OPC (Organic Photoconductor) is provided, and is disposed below the exposure device 53 and controlled so as to be rotated in a predetermined direction (the direction of an arrow F in the figure) by driving means and control means.

The charging device 52 is a charging means that uniformly charges the surface of the photoreceptor 51 to a predetermined potential, and is arranged above the photoreceptor 51 so as to be proximate to the peripheral surface thereof. In this embodiment, a contact type charging roller is used, but a charging device of a charger type, a brush type, an ion emission-charging type or the like may be used.

The exposure device 53 has a function to write an electrostatic latent image according to the image data output from an image processing portion on the surface of the photoreceptor 51 that is charged by the charging device 52 by irradiating the surface, with laser light. The exposure device 53 forms an electrostatic latent image corresponding to each color when image data corresponding to yellow, magenta, cyan, or black is input respectively according to the image forming stations 50Y, 50M, 50C, or 50B. As the exposure device 53, a laser scanning unit (LSU) provided with a laser irradiation portion and a reflection mirror or a write device (for example, a write head) in which light emitting elements such as ELs and LEDs are arranged in an array is usable.

The developing device 1 has a developing roller 3 for serving as a developer carrier that carries a developer. The developing roller 3 is configured so that the developing roller 3 is proximate to the photoreceptor 51 and the developer is transported to a development area in which a toner moves to the photoreceptor 51. In this embodiment, the developing device 1 is a so-called single-component developing device which uses a toner as a developer, and forms a toner image (visible image) by developing an electrostatic latent image that has been formed on the surface of the photoreceptor 51 by the exposure device 53.

The developing device 1 contains a yellow, magenta, cyan, or black developer according to image formation of the respective image forming stations 50Y, 50M, 50C, and 50B. The developer includes a toner that is charged with the same polarity as that of the surface potential of the charged photoreceptor 51. Note that, the polarity of the surface potential of the photoreceptor 51 and the charged polarity of the toner used can be positive or negative but are negative in this exemplary configuration.

The transfer roller 55 transfers a toner image formed on the photoreceptor 51 to the surface of the sheet P that is transported by a transport belt 33, and has a transfer roller to which a bias voltage that has a polarity (positive polarity in this exemplary configuration) opposite to the charged polarity of the toner is applied.

The cleaning device 56 removes and collects the toner remaining on the peripheral surface of the photoreceptor 51 after the toner image is transferred to the sheet P. In this exemplary configuration, the cleaning device 56 is arranged at the position substantially opposite to the developing device across the photoconductor 51 and at the side of the photoconductor 51.

The transport portion 30 is provided with a drive roller 31, a driven roller 32, and the transport belt 33, and transports the sheet P to which toner images in the respective colors are transferred in the respective image forming stations 50Y, 50M, 50C, and 50B. The transport portion 30 is configured so that the endless transport belt 33 is routed around the drive roller 31 and the driven roller 32, and sequentially transports the sheet P that is fed from the feed tray 60 to each of the image forming stations 50Y, 50M, 50C, and 50B, when the transport belt 33 moves in the direction of an arrow Z.

The fixing device 40 is provided with a heat roller 41 and a pressure roller 42, and applies heat and pressure to the toner image transferred onto the sheet P to fix on the sheet P by transporting the sheet P to a fixing nip portion on which these rollers abut.

In the image forming apparatus 100 in such a configuration, when the sheet P that is transported by the transport portion 30 passes through positions at which the photoreceptor 51 faces the respective image forming stations 50Y, 50M, 50C, and 50B, the toner images on the respective photoreceptors 51 are successively transferred onto the sheet P by the action of a transfer electric field of the transfer roller 55 that is arranged below the facing positions thorough the transport belt 33. Thereby, the toner images of respective colors are transferred onto the sheet P to lie on top of each other and a desired full-color toner image is formed on the sheet P. The sheet P on which the toner images are transferred in this manner is subjected to fixing processing of the toner images at the fixing device 40 and thereafter is discharged to a discharge tray.

As described above, the developing device according to the present invention is a developing device employing single-component development which applies a bias voltage to the developing roller 3 and develops an electrostatic latent image formed on an electrostatic latent image carrier using a toner.

Moreover, the developing device according to a first embodiment of the present invention differentiates adhesion of a toner and the blade between a part where the blade for regulating a toner layer is proximate to the developing roller and an upstream part in a rotational direction of the developing roller so that the toner moves easily in the upstream part, and thus improves uniformity of the toner layer on the developing roller while preventing aggregation of the toner.

Further, in addition to the first embodiment, the developing device according to a second embodiment of the present invention loosenes up aggregation of toner and produces a flow of the toner in the upstream side of the blade by arranging an auxiliary rotatable member such as a roller proximate to the developing roller 3 between a part where the developing roller is proximate to the blade and a part where the developing roller 3 contacts with the supply roller. Moreover, this effect is obtained even by the developing device only with the configuration added in the second embodiment, in other words, by the developing device in which the auxiliary rotatable member is only arranged without differentiating adhesion of the blade between the upstream part and the downstream part.

First, the configuration of the developing device 1 according to the first embodiment will be described with reference to FIGS. 2 to 7.

Figure 2:
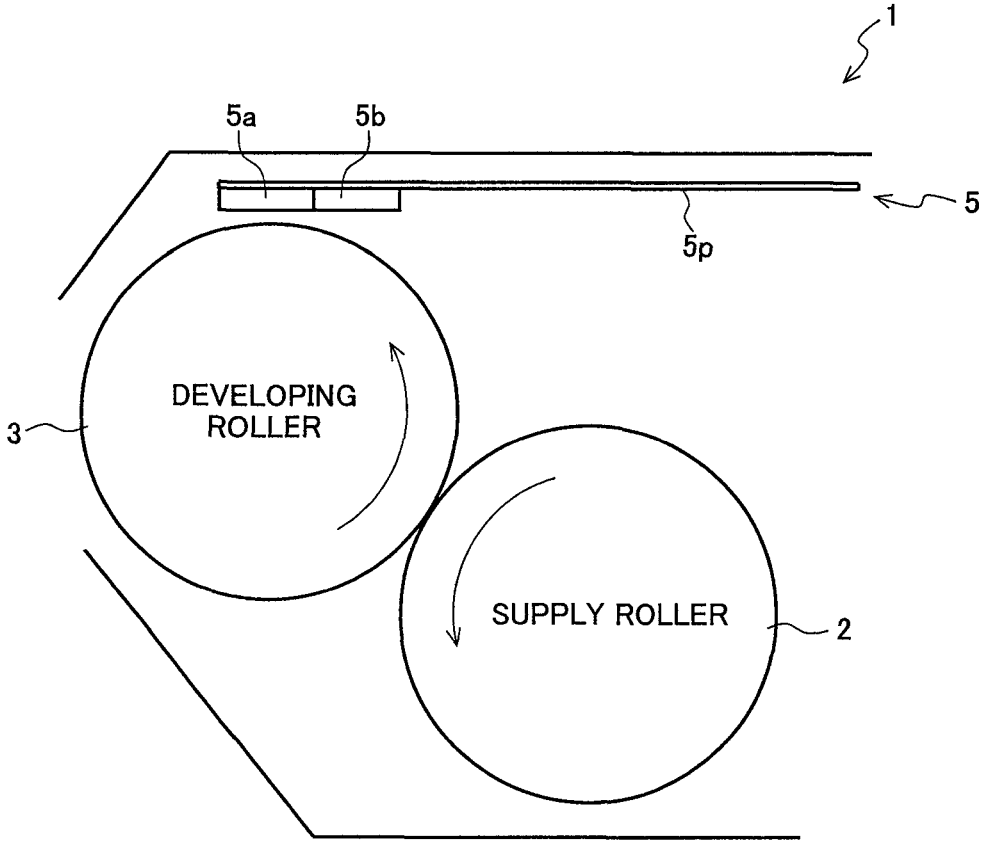
FIG. 2 is a schematic view showing an exemplary configuration of a developing device according to a first embodiment of the present invention.
Figure 3A:
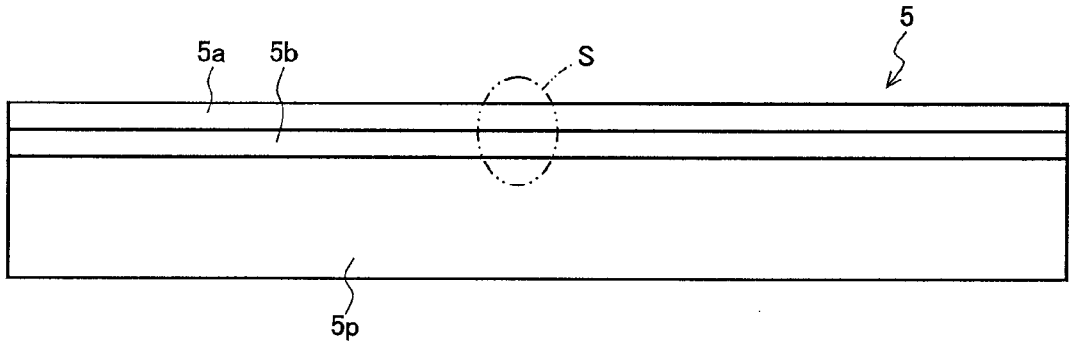
FIGS. 3A to 3C are schematic views showing an exemplary configuration of a blade in the developing device of FIG. 2.
Figure 3B:
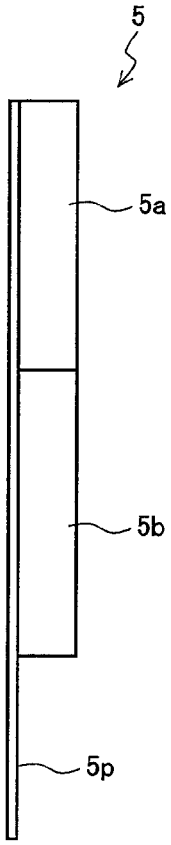
Figure 3C:
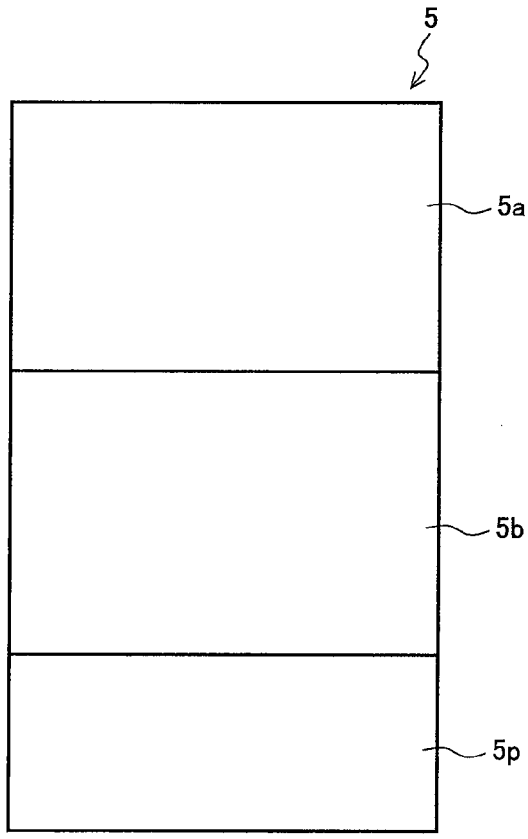
Figure 4:
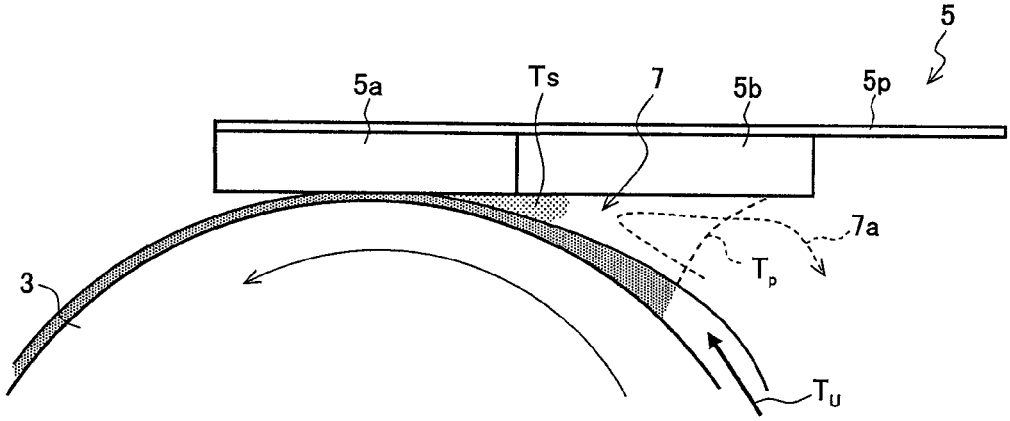
FIG. 4 is a schematic view showing a position relation between the blade and a developing roller in the developing device of FIG. 2 and a flow of a toner.
Figure 5:
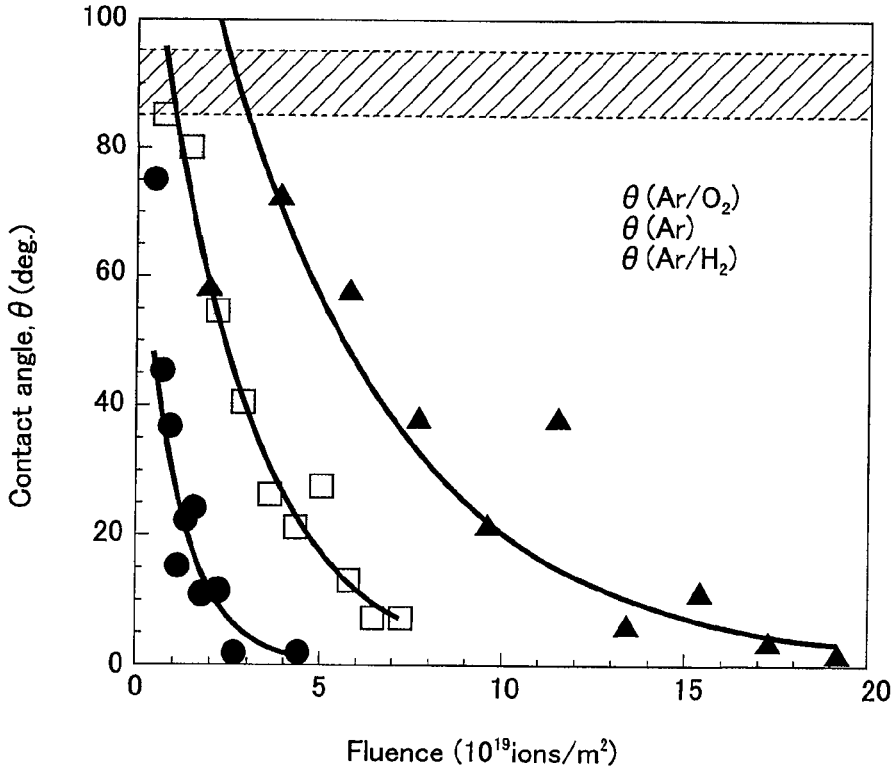
FIG. 5 is a view cited from a document for describing an effect in processing of the developing device of FIG. 2.
Figure 6A:
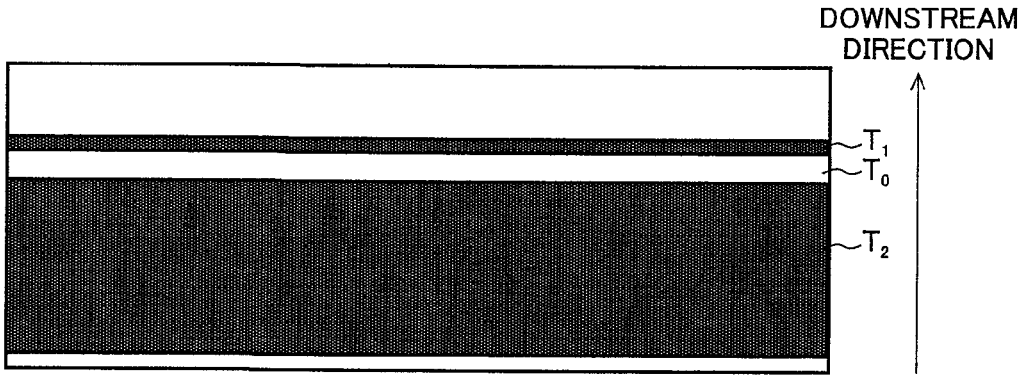
FIG. 6A and FIG. 6B are views for describing a toner adhering to the blade when the present invention is implemented, in comparison with a conventional device.
Figure 6B:
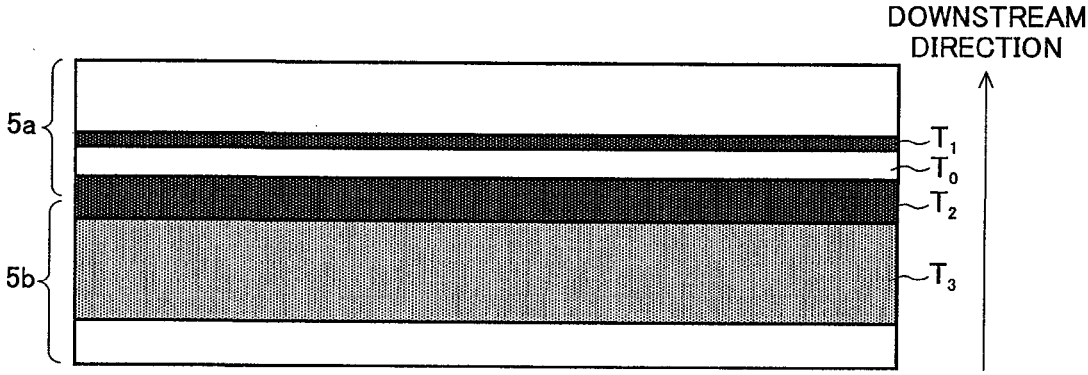

FIG. 2 is a schematic view showing an exemplary configuration of the developing device 1 provided in the image forming station portion 50 shown in FIG. 1, and is a schematic view showing an exemplary configuration of the developing device according to the first embodiment of the present invention. In addition, FIGS. 3A to 3C are schematic views showing an exemplary configuration of the blade in the developing device of FIG. 2, and FIG. 4 is a schematic view showing a position relation between the blade and the developing roller in the developing device of FIG. 2 and a flow of a toner. Moreover, FIG. 5 is a view cited from a document for describing an effect in processing of the developing device of FIG. 2, and FIG. 6A and FIG. 6B are views for describing a toner adhering to the blade when the present invention is implemented, in comparison with a conventional toner.

The developing roller 3 holds a development gap with the photoreceptor. The development gap is a gap holding member (not shown), which is 150 to 500 μm. The supply roller 2 contacts with the developing roller 3 at a nip portion. The developing roller 3 is made of aluminum and the like, and surface roughness Ra thereof is configured to be 0.3 to 0.6 μm. The supply roller 2 is formed of urethane rubber and the like, and an amount of intrusion of the nip portion is 0.2 to 0.8 mm. The rotational direction of the developing roller 3 is set to be opposite to that of the supply roller 2 with respect to the rotational direction of the photoreceptor, but may be set to be the same direction. A toner stirring roller not-shown which stirs a toner and transports the toner to the toner supply roller 2 is provided.

To the developing roller 3, a DC voltage or an AC voltage superimposed on the DC voltage is applied. The same bias is often applied to the developing roller 3 and the blade 5 for regulating a toner layer. Moreover, there are cases where the same bias is applied to the supply roller 2 as that of the developing roller 3 and where a DC potential difference of about 50 V to 200 V is provided so that the toner moves easily from the supply roller 2 to the developing roller 3.

The toner is a polyester toner whose average volume particle diameter is 9 μm, to which 3.0 wt % of silica and 0.75 wt of titanium oxide are added as an external additive, respectively. The toner transported to the supply roller 2 by the stirring roller is scraped with the developing roller 3 at the nip portion and applied with a charge amount, and the toner is pumped up to the developing roller 3 to form a toner layer. When passing through a rubber layer of the blade 5, the toner is then charged again at the same time when a layer thereof is regulated with pressure from the blade 5. The toner passed through the blade 5 visualizes the latent image developed on the photoreceptor according to the voltage applied to the developing roller 3 and a latent image potential on the photoreceptor.

FIG. 3A is a top view of the blade 5 for regulating a toner layer, and FIG. 3B and FIG. 3C show a sectional view and an enlarged view of an area S in FIG. 3A, respectively. As illustrated in FIGS. 3A to 3C, the blade 5 is comprised of a plate 5*p* and an elastic body layer. The plate 5*p* of the blade 5 is made of phosphor bronze with thickness of 0.1 to 0.2 mm and the elastic body layer at a tip end is made of elastic rubber with thickness of about 1 to 2 mm and the like.

Further, as shown in FIG. 2 and FIGS. 3A to 3C, the elastic body layer is comprised of two areas 5*a* and 5*b*. That is, the elastic body layer is comprised of the downstream area 5*a* in the rotational direction of the developing roller including a most proximate part to the developing roller 3 and the upstream area 5*b* in the rotational direction of the developing roller not including the most proximate part. A position relation between the developing roller 3 and the blade 5 is as shown in FIG. 4.

Moreover, in this embodiment, it is configured such that adhesion of the toner and the blade 5 in the upstream area 5*b* is smaller than that in the downstream area 5*a*.

To be more specific, first, in the most proximate area of the developing roller 3 and the blade 5, not less than certain adhesion is required between the toner and the blade 5 in order to charge the toner, whereas, when adhesion is enhanced in the upstream area of the blade 5, the flow of the toner becomes poor and aggregation easily occurs, for example, such as aggregation occurring even to an area Tp.

Thus, in this embodiment, this problem is solved by dividing the blade 5 into two areas having different adhesion to the toner and making adhesion smaller in the upstream side than in the downstream side. As a result, as shown in FIG. 4, it is possible to prevent toner aggregation by improving the flow of the toner in the upstream side as shown by an arrow 7*a* of dotted line while keeping a charging capability with a stagnated portion Ts, thus making it possible to suppress deterioration of the toner and perform layer regulation stably.

That is, according to the developing device of the first embodiment of the present invention, toner aggregation is made difficult to occur between the developing roller 3 and the blade 5 in the upstream side of the most proximate area of the developing roller 3 and the blade 5, and uniformity of the toner layer on the developing roller 3 is increased, so as to be able to perform development which does not apply heavy stress and is excellent in uniformity. Here, an example is cited that the length of the upstream area 5*b* is the same as that of the downstream area 5*a*, but the upstream area 5*b* may be determined for the area in which tonner aggregation is desirably prevented, without limitation thereto.

In order to make adhesion of the toner smaller in the upstream area 5*b* than in the downstream area 5*a*, it is only required to select a material of the elastic body layer or apply a surface treatment. Various examples of which will be described below.

As a material of the elastic body layer, silicon rubber is usable.

The surface of the silicon rubber generally shows hydrophobicity. In this example, the surface of the downstream area 5*a* is kept as the general silicon surface, and only the upstream area 5*b* is hydrophilized by an $Ar/O_2$ plasma treatment. Since the toner shows hydrophobicity, the silicon rubber of the downstream area 5*a* showing hydrophobicity is easily adhered to the toner. On the other hand, the silicon rubber of the upstream area 5*b* showing hydrophilicity is difficult to be adhered to the toner.

The state of the toner near the blade 5 in this state is as shown in FIG. 4. That is, a part of a toner Tu pumped up over the developing roller 3 advances over the developing roller 3 as it is. Moreover, since the blade 5 of the upstream area 5*b* has small adhesion to the toner, the toner near the blade 5 moves easily and a part of the toner returns on the flow in the toner stagnated portion as shown by the arrow 7*a* of dotted line. It is therefore possible to reduce the static toner while securing the toner stagnated portion Ts, thus making it possible to suppress aggregation of the toner.

Note that, though the silicon rubber is hydrophilized by the plasma treatment in the above, this method has been well known. For reference, a reported case is shown in FIG. 5 and below.

"Hydrophilization of polydimetylsiloxane surface using glow discharge" (Hokkaido University, Yusuke IGARASHI etc.: 23rd meeting for research presentation of Hokkaido branch of Atomic Energy Society of Japan, 2005)

Discharge gas: Ar, $Ar/H_2$, $Ar/O_2$

Applied voltage: 300 V

Irradiation time: 1 to 10 minutes

As shown in FIG. 5, it is found that a contact angle with water is 80 to 100 degrees and hydrophobicity (water repellency) is shown before the plasma treatment, but the contact angle is decreased to 10 degrees or less after the treatment, leading to hydrophilicity. As the gas, it is possible to lead to hydrophilicity at earliest by using $Ar/O_2$.

Note that, since the plasma treatment needs to be performed only for the upstream area 5*b*, the downstream area 5*a* needs to be masked with a protection sheet or the like at the time of the plasma treatment.

In this manner, by performing the plasma surface treatment with the downstream area 5*a* masked, the blade 5 differentiates the direction of hydrophilicity of only the upstream area 5*b* to be hydrophilized, thus making it possible to decrease adhesion to the toner in the upstream area 5*b*.

Moreover, as a material of the elastic body layer of the blade 5, urethane rubber is usable.

The surface of the urethane rubber generally shows hydrophobicity. In this example, the surface of the downstream area 5*a* is kept as the general urethane surface, and only the upstream area 5*b* is hydrophilized by a corona discharge treatment. Since the toner shows hydrophobicity, the urethane rubber of the downstream area 5*a* showing hydrophobicity is easily adhered to the toner. On the other hand, the urethane rubber of the upstream area 5*b* showing hydrophilicity is difficult to be adhered to the toner. When a voltage is applied to a needle electrode or a metal wire, a highly intense electric field is formed near the metal and discharge occurs with emission of light. This is generally called corona discharge. The corona discharge treatment has a characteristic that the treatment is possible with a low current density and at about an atmospheric pressure.

The method for modifying the resin surface and enhancing wetability by the corona discharge treatment is generally known. The mechanism thereof is considered as follows. With corona discharge, a gas component such as oxygen is brought into an energetic plasma state and collides with the urethane surface, and polar groups (such as OH groups and carbonyl groups) having hydrophilicity are generated on the surface, thus enhancing wetability. By performing the corona discharge treatment, urethane which has shown hydrophobicity in which the contact angle with water is about 110 degrees before the treatment shows hydrophilicity with the angle of 50 degrees or less after the treatment. Note that, since the corona treatment needs to be performed only for the upstream area 5*b*, the downstream area 5*a* needs to be masked with a protection sheet or the like at the time of the treatment.

The result of comparing the case where the contact angle in the upstream area 5*b* is kept 110 degrees and the case where the contact angle is slightly decreased to 90 degrees is shown in FIG. 6A and FIG. 6B. The former is the case where the downstream area 5*a* and the upstream area 5*b* have the same contact angle, which corresponds to usage of a conventional blade. In FIG. 6A and FIG. 6B, the results of observing that both blades 5 are used and the blades 5 are then removed in the development tank of FIG. 2 is shown as schematic views.

Figure 13:
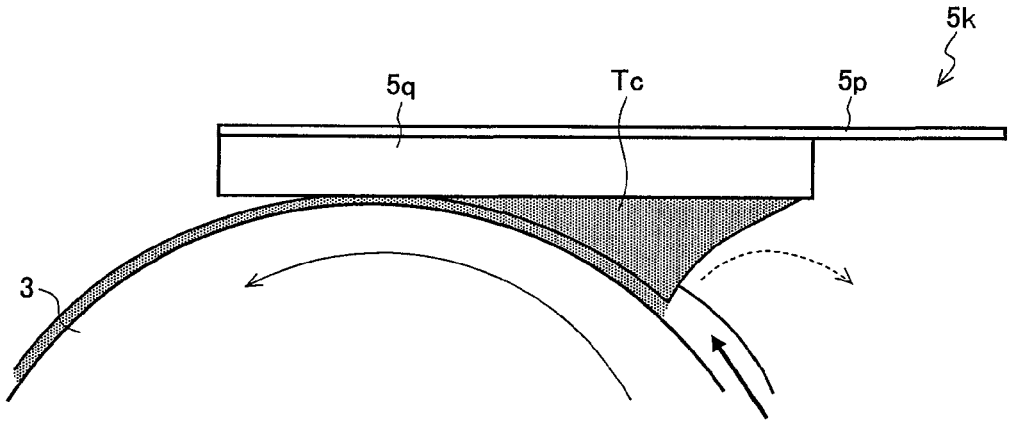
FIG. 13 is a schematic view showing a state of a toner before passing through a layer regulating blade in a conventional developing device.

In the case of the conventional blade, as shown in FIG. 6A, much more toners are adhered to a part $T_2$ in the upstream side of a most proximate part $T_0$ of the blade and the developing roller 3, further to a part $T_1$ in which the toner is adhered to the blade. That is, as described in FIG. 13, there are a lot of toners that are likely to be static and aggregate to each other in the upstream side of the blade.

On the other hand, in the case of the blade 5 of the present invention, as shown in FIG. 6B, much toners are present in a part $T_2$ in the right upstream side of a most proximate part $T_0$ of the blade 5 and the developing roller 3, further to a part $T_1$ in which the toner is adhered to the blade, whereas, a part $T_3$ in the slightly upstream side has a thinner toner layer adhered to the blade 5. This shows that adhesion of the toner and the blade 5 in the upstream area 5*b* is decreased, resulting that, the toner approaching to the downstream area 5*a* from the upstream area 5*b* is considered to move on the toner stagnated portion with the flow of the toner as shown by an arrow 7*a* of FIG. 4.

Accordingly, this system enables to produce the flow of the toner and prevent aggregation of the toner.

In this manner, by performing the corona discharge treatment with the downstream area 5*a* masked, the blade 5 differentiates the direction of hydrophilicity of only the upstream area 5*b* to be hydrophilized, thus making it possible to decrease adhesion to the toner in the upstream area 5*b*.

Moreover, as another example of the surface treatment, only the upstream area 5*b* may be selectively irradiated with XeCl excimer laser (wavelength of 308 nm) to reduce the contact angle of the surface. The case where urethane rubber is used as the elastic body layer of the blade 5 will be described as an example.

Seeking to modify the surface by excimer laser itself is a well-known technology.

For example, Japanese Patent No. 3125047 describes that a polyurethane film was irradiated at room temperature with 600 pulses of XeCl excimer laser (wavelength: 308 nm) at 40 $mJ/cm^2$/pulse through a quartz plate, resulting that, the contact angle of water on the film surface decreased from 110 degrees to 90 degrees. Though it is described that the contact angle decreased to 60 degrees when irradiation was carried out in water including alginic acid, decrease to 90 degrees even in the air is sufficient for the present object. Note that, the above-described patent describes that there was no effect when a near infrared laser beam (YAG laser beam fundamental waves, wavelength: 1064 nm) was used, thus it is found that short wavelength laser needs to be irradiated.

Since it is only required to put the blade 5 on a stage and irradiate only the upstream area 5*b* with laser, masking is not particularly required in this system.

Moreover, as described above, for example, it is possible that the downstream area 5*a* has the contact angle of 110 degrees and the upstream area 5*b* has the contact angle of 90 degrees, thus making it possible to produce the flow of the toner as shown in FIG. 4.

In this manner, by irradiating only the upstream area 5*b* with excimer laser light, the blade 5 differentiates the direction of hydrophilicity of only the upstream area 5*b* to be hydrophilized, thus making it possible to decrease adhesion to the toner in the upstream area 5*b*.

In addition, illustration has been given using the plasma treatment, the corona discharge treatment, and the excimer laser irradiation treatment, but without limitation thereto, the blade 5 is able to have smaller adhesion to the toner in the upstream area 5*b* than that of the downstream area 5*a* by making hydrophilicity on the surface of the upstream area 5*b* higher than that of the surface of the downstream area 5*a*. This is because, the toner generally has hydrophobicity, and therefore, when the blade 5 has the same hydrophobicity, adhesion of both the toner and the blade becomes high, and the toner is more easily bounced off when the blade 5 has hydrophilicity, so that adhesion to the toner is able to be decreased.

In addition, illustration has been given using the plasma treatment, the corona discharge treatment, and the excimer laser irradiation treatment, but without limitation thereto, the blade 5 is able to have smaller adhesion to the toner in the upstream area 5*b* than that of the downstream area 5*a* when the upstream area 5*b* and the downstream area 5*a* have the same material and have different hydrophilicity by the surface treatment. Alternatively, when the blade 5 having elastic body layers formed by two materials is used, a step is easily formed on a joint portion between the upstream side and the downstream side and the flow of the toner is likely to be influenced. Such influence is not likely to be given by preparing the blades 5 with the same material and differentiating hydrophilicity only by the surface processing.

Moreover, though hydrophilicity is differentiated between the downstream area 5*a* and the upstream area 5*b* by the surface treatment in each example described above, the materials of the downstream area 5*a* and the upstream area 5*b* may be differentiated. An example of which will be taken.

In this example, a material using silicon as a base is used as the elastic body layer of the blade 5. As described above, silicon generally shows hydrophobicity. There is a material called silicon hydrogel prepared by blending silicon with hydrophilic gel and this material is known to show hydrophilicity. For example, it is possible to bring hydrophilicity by polymerizing hydroxyethyl methacrylate with silicon.

When the upstream area 5*b* uses the above-described material and the downstream area 5*a* uses a general silicon material, it is possible to form the blade 5 having elastic body layers with different hydrophilicity. By using materials with different hydrophilicity (materials with different water repellency), even when the blade 5 is ground down by the toner or the like, the surface nature is not changed and the effect is easily remained for a long period of time.

In this manner, the blade 5 may increase hydrophilicity of the upstream area 5*a* by using materials with different hydrophilicity for the upstream area 5*b* and the downstream area 5*a*. By using the materials with different hydrophilicity, even when the blade 5 is ground down by the toner or the like, the surface nature is not changed and the effect is easily remained for a long period of time.

Moreover, as another example, the blade 5 may have smaller surface roughness in the upstream area 5*b* than surface roughness in the downstream area 5*a*. As the elastic body layer of the blade 5, for example, urethane rubber is usable. It is set such that the downstream area 5*a* has Ra of 0.2 μm, and the upstream area 5*b* has Ra of 0.05 μm. Since lager Ra provides higher capability of stopping the toner, the downstream area 5*a* including the most proximate part to the developing roller 3 has larger Ra and the upstream area 5*b* in which the toner is preferred to be flown easily has smaller Ra.

In this manner, the upstream side has smaller surface roughness, so that a force of preventing the flow of the toner in the upstream area 5*b* of the blade 5 is decreased, whereas, the downstream area 5*a* of the blade 5 including the area proximate to the developing roller 3 has larger surface roughness than that of the upstream area 5*b*, so that the force of stopping the toner is increased. This makes it possible to reduce the static toner and produce the flow of the toner, and to suppress aggregation of the toner.

Moreover, with miniaturization of an image forming apparatus, a diameter of the developing roller 3 tends to be reduced. In this case, there arises a case where the toner stagnated portion shown in FIG. 4 is difficult to be formed and the toner layer after passing through the blade 5 is not stabilized.

Figure 7:
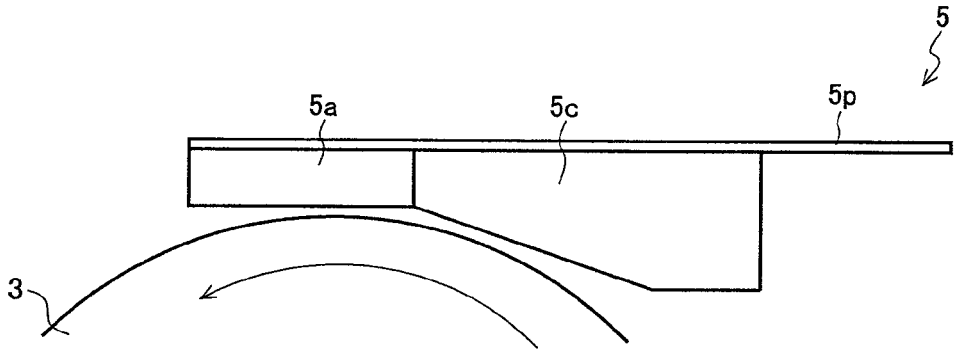
FIG. 7 is a schematic view showing another exemplary configuration of the blade in the developing device of FIG. 2.

In such as case, it is considered to increase thickness in the upstream side of the blade 5 as shown in FIG. 7 so that the toner stagnation is easily formed, for the purpose of stabilizing the toner layer. Here, FIG. 7 is a schematic view showing another exemplary configuration of the blade 5, and in the figure, an arrow shows the rotational direction of the developing roller 3. When it is configured such that the toner stagnation is easily formed as shown in FIG. 7, however, toner aggregation occurs easily. Accordingly, also in this configuration, as has been described as the areas 5*a* and 5*b*, it is necessary that the blade 5 is divided into two areas 5*a* and 5*c* and, for example, the surface of the blade in the upstream side is hydrophilized, so that adhesion of the toner in the upstream area 5*b* is made smaller than that of the downstream area 5*a* to thereby flow the toner easily and prevent aggregation of the toner.

When the upstream side has larger thickness than that of the downstream side, stability of a transport amount is enhanced. However, toner aggregation occurs easily in the upstream side. Thus, by decreasing adhesion between the blade 5 and the toner in the upstream area, the toner flows easily, and the above-described failure is made up, so that it is possible to suppress deterioration of the toner while stabilizing the transport amount.

Next, the developing device according to the second embodiment will be described with reference to FIGS. 8 to 11.

Figure 8:
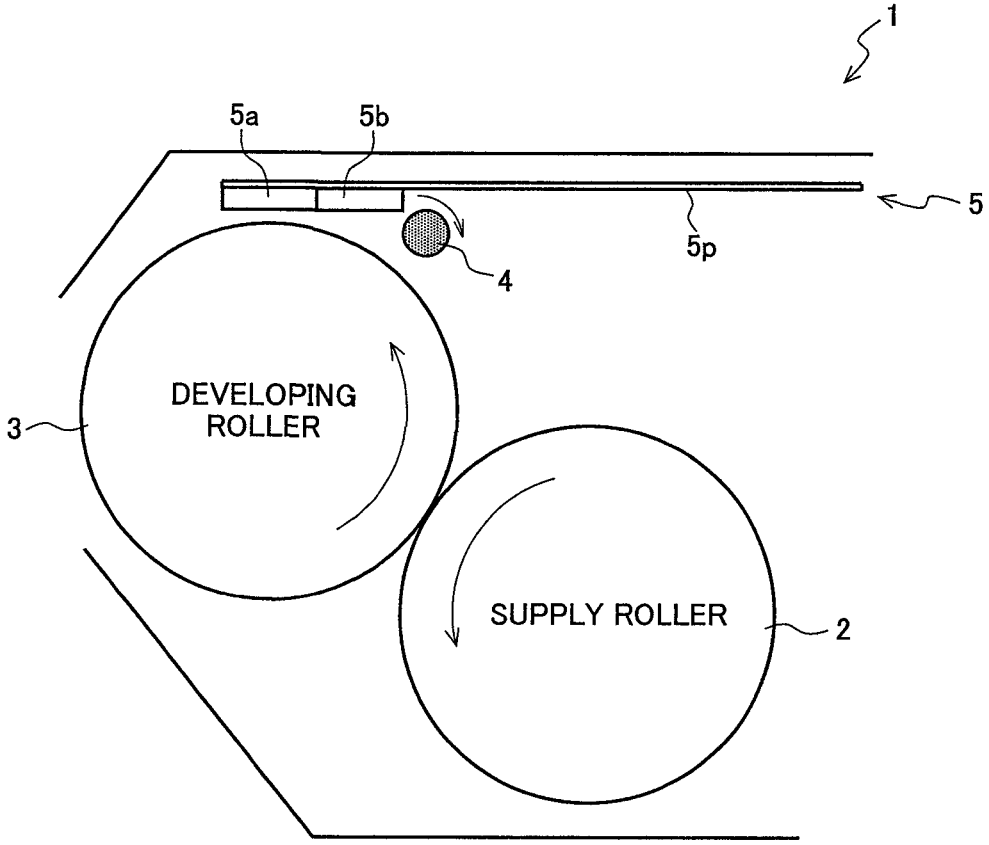
FIG. 8 is a schematic view showing an exemplary configuration of a developing device according to a second embodiment of the present invention.
Figure 9:
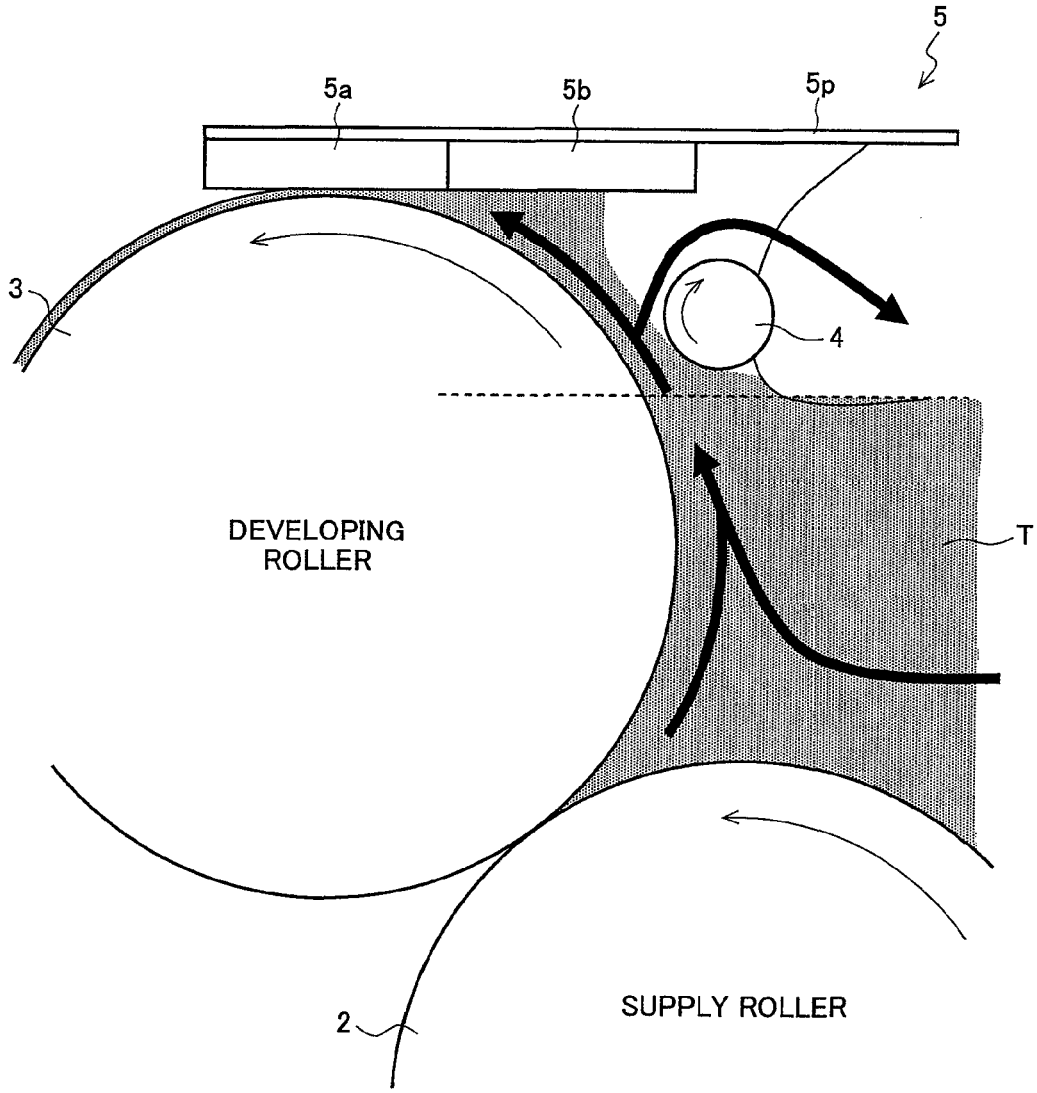
FIG. 9 is a schematic view showing a position relation between a blade, a developing roller and an auxiliary rotatable member in the developing device of FIG. 8 and a flow of a toner.
Figure 10:
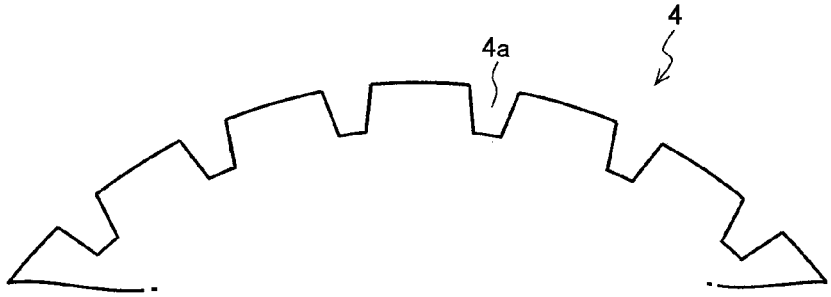
FIG. 10 is a schematic view showing an example of the auxiliary rotatable member in the developing device of FIG. 8.
Figure 11:
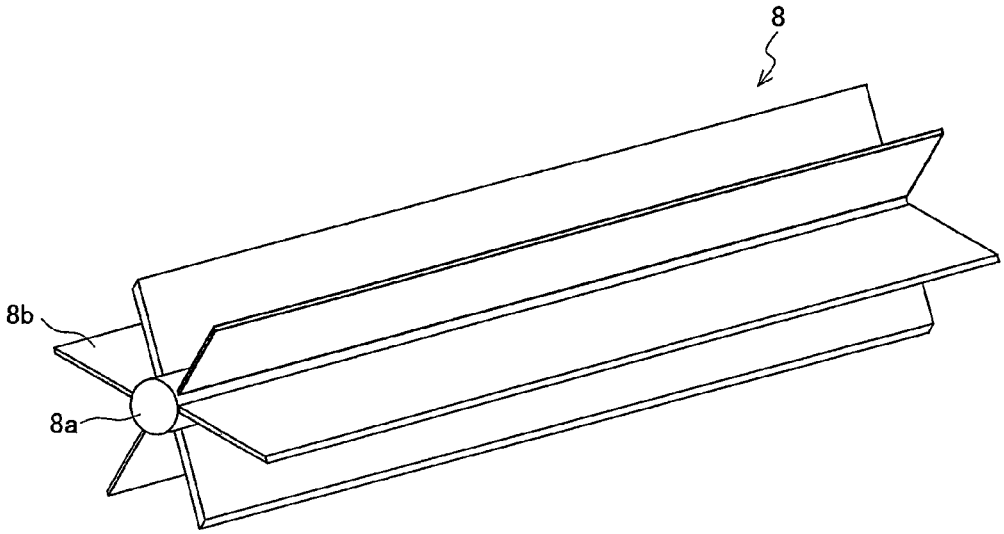
FIG. 11 is a schematic view showing another example of the auxiliary rotatable member in the developing device of FIG. 8.

FIG. 8 is a schematic view showing an exemplary configuration of the developing device according to the second embodiment of the present invention, and FIG. 9 is a schematic view showing a position relation between a blade, a developing roller and an auxiliary rotatable member in the developing device of FIG. 8 and a flow of a toner. Note that, in FIG. 9, arrows illustrated in the developing roller 3 and the supply roller 2 show rotational directions thereof and dotted straight line shows the averaged toner surface. In addition, FIG. 10 is a schematic view showing an example of the auxiliary rotatable member in the developing device of FIG. 8, and FIG. 11 is a schematic view showing another example of the auxiliary rotatable member.

The developing device 1 according to the second embodiment arranges an auxiliary rotatable member 4 at a position proximate to the developing roller 3 between a part where the developing roller 3 is proximate to the blade 5 and a part where the developing roller 3 contacts with the supply roller 2. Here, the auxiliary rotatable member 4 rotates in a direction opposite to the developing roller 3. The control of the rotation may be carried out such as by a control portion which is provided separately, with the control of the rotation of the developing roller 3 and the like.

The auxiliary rotatable member 4 is aimed to move the toner stagnated in front of the blade 5 forcibly. When the stagnation time becomes longer, the toner is pushed and hardened to be deteriorated or aggregated. Since the flow of the toner in the neighborhood is able to be produced by rotating the auxiliary rotatable member 4, the toner that is likely to be aggregated is loosened up and is moved on the flow.

The state of the toner near the blade 5 in this state is as shown in FIG. 9. The toner moving to the developing roller 3 in the contact portion with the supply roller 2 is risen up with the rotation of the developing roller 3. At this time, with the rotation of the developing roller 3, the surrounding toner is also risen up together, so that there are much more toners in front of the blade 5.

Figure 14:
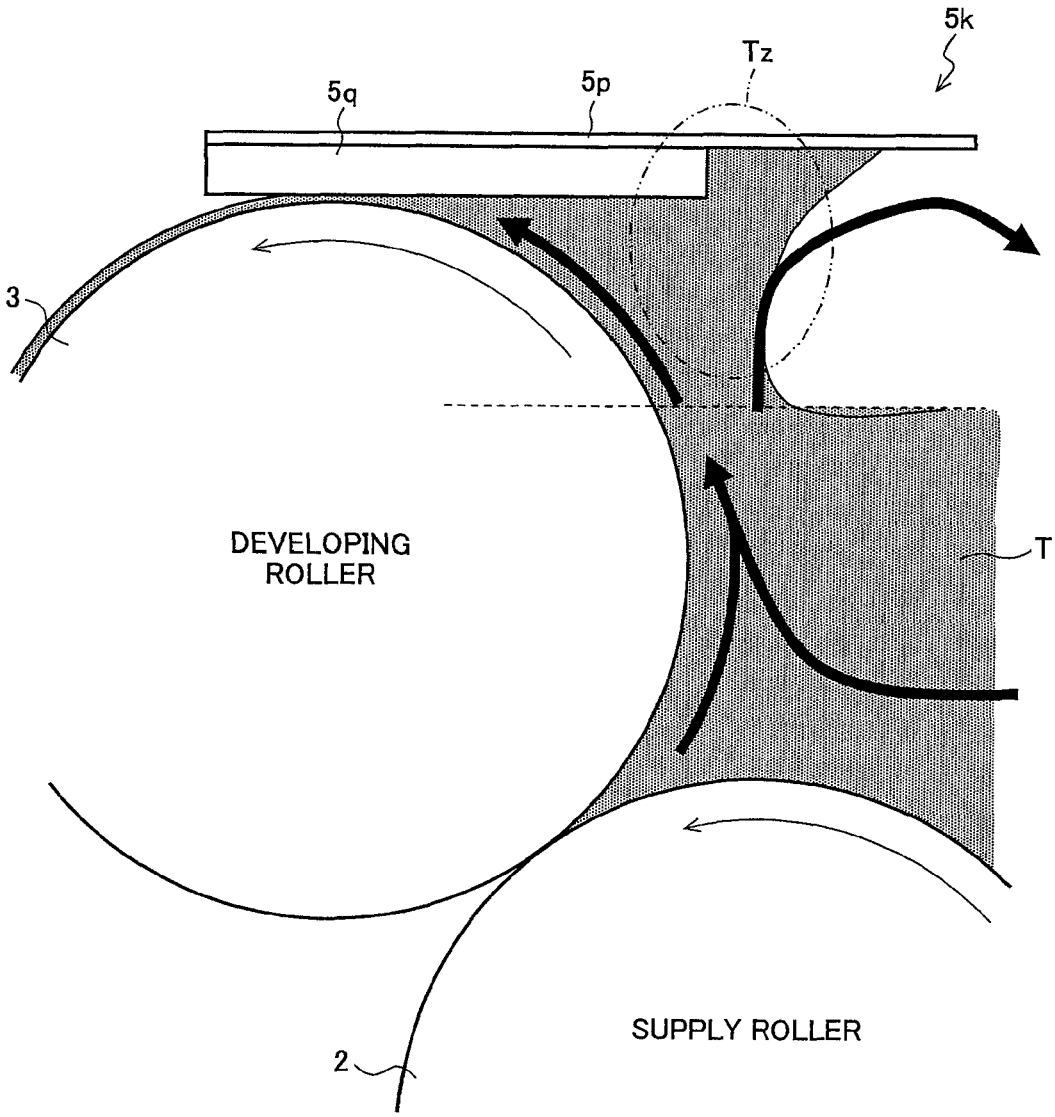
FIG. 14 is a schematic view showing a state where a toner is further aggregated compared to the state of FIG. 13.

With the rotation of the auxiliary rotatable member 4, the toner that is likely to be aggregated around the auxiliary rotatable member 4 is loosened up and is moved in the rotational direction. Further, since the blade 5 of the upstream area 5*a* has low adhesion to the toner, the toner near the blade 5 moves easily and movement of the toner with the rotation of the auxiliary rotatable member 4 is prompted, so that the toner is more easily moved. Accordingly, it is possible to reduce the static toner, so that the range is limited to an aggregation range which is narrower than a range shown by solid line (range of the toner shown in FIG. 14) as shown in FIG. 9, thus making it possible to suppress aggregation of the toner.

When the toner amount is particularly large, a lot of toners are carried before passing through the blade 5, so that much toners are stagnated and the toners are pushed and hardened to be aggregated. When the aggregation starts to occur, for example, such a negative effect is caused that the surrounding toner is difficult to move, aggregation is further advanced, the toner is deteriorated, and uniformity of the toner layer passing through the blade 5 is further deteriorated. However, like the second embodiment, by providing the auxiliary rotatable member 4 for rotation, the flow of the toner is forcibly produced, so that aggregation is prevented, and there is an effect of loosening up the toner that has begun to be aggregated. This makes it possible to reduce the static toner and produce the flow of the toner as shown in FIG. 9, resulting that it is possible to suppress deterioration of the toner and to keep excellent uniformity of the toner layer.

In addition, by using the form in which the blade 5 is divided into two areas 5*a* and 5*b* having different adhesion with the toner in combination, it is possible to improve the flow of the toner in the upstream area and prevent aggregation of the toner while keeping a charging capability, thus making it possible to prompt the flow of the toner produced by the rotation of the auxiliary rotatable member 4, suppress toner deterioration, and perform layer regulation stably.

In this manner, according to the developing device of the second embodiment of the present invention, by arranging the auxiliary rotatable member 4, toner aggregation is made difficult to occur between the developing roller 3 and the blade 5 in the upstream side of the most proximate area of the developing roller 3 and the blade 5 for regulating the toner layer, and uniformity of the toner layer on the developing roller 3 is increased, so as to be able to perform development which does not apply heavy stress and is excellent in uniformity.

Next, a specific example of the auxiliary rotatable member 4 will be described.

As the auxiliary rotatable member 4, a metal roller is usable. The metal roller is set to have, for example, surface roughness Ra of 1 μm or more. The larger Ra of the auxiliary rotatable member 4 is, the higher the capability of transporting the toner is. As described above, the surface roughness Ra of the developing roller 3 is 0.3 to 0.6 μm, and the toner transport capability of the auxiliary rotatable member 4 is set to be higher than the toner transport capability of the developing roller 3.

Further, the upstream area 5*b* of the blade 5 is set to have surface roughness Ra of 0.1 μm or less, so that the toner moves more easily in the auxiliary rotatable member 4 and the movement of the toner by the rotation of the auxiliary rotatable member 4 spans a wider range.

In this manner, when the auxiliary rotatable member 4 is set to have the surface roughness larger than surface roughness in the upstream side of the blade 5, the toner near the blade 5 also moves easily with the rotation of the auxiliary rotatable member 4 and the flow of the toner becomes easily formed. Such roughness is able to be employed even without using the metal roller, however, the metal roller causes the toner to be hardly fixed to the surface of the roller and makes it possible to produce the stable flow of the toner.

Moreover, as the auxiliary rotatable member 4, a metal roller having a groove 4*a* formed on the surface thereof may be used, the shape of which is shown in FIG. 10. Of course, the metal roller may also not be used in this example. In this example, the depth of the groove 4*a* is set to, for example, around 0.2 mm. The toner enters between the grooves 4*a* and the intense flow of the toner is formed near the metal roller. By forming the groove 4*a*, the toner transportation capability is enhanced in the auxiliary rotatable member 4, the toner near the blade 5 also moves easily with the rotation of the auxiliary rotatable member 4, and the flow of the toner is easily formed. Moreover, also in the example in which the groove 4*a* is provided, due to the surface roughness of the part other than the groove 4*a* (and the part of the groove 4*a*), the auxiliary rotatable member 4 preferably has larger surface roughness.

In addition, as the auxiliary rotatable member 4, an auxiliary rotatable member 8 having blades 8*b* vertical to a rotational axis 8*a* may be arranged, the shape of which is shown in FIG. 11. In this manner, by providing a plurality of blades 8*b*, the toner transportation capability is enhanced in the auxiliary rotatable member 8, the toner near the blade 5 also moves easily with the rotation of the auxiliary rotatable member 8, the toner is loosed up, and the flow of the toner is easily formed. Note that, the number of the blades 8*b* is not limited.

Moreover, when the developing roller 3 and the auxiliary rotatable member 4 stop at the same time, this stoppage is in the state where many toners still remain in an area surrounded by the blade 5, the developing roller 3, and the auxiliary rotatable member 4 (8), so that aggregation sometimes occurs in that part after lapse of time.

In order to prevent this, the auxiliary rotatable member 4 is set to be stopped later. That is, it is preferably set such that when the development step is finished, after a certain time has elapsed after the developing roller 3 stops, the auxiliary rotatable member 4 stops. The certain time is, for example, about 0.5 second to 1 second. With the rotation for this time, the toner in the area surrounded by the blade 5, the developing roller 3, and the auxiliary rotatable member 4 (8) is poured out and reduced, so that the toner aggregation is difficult to occur even when a time has elapsed after stoppage.

Figure 12:
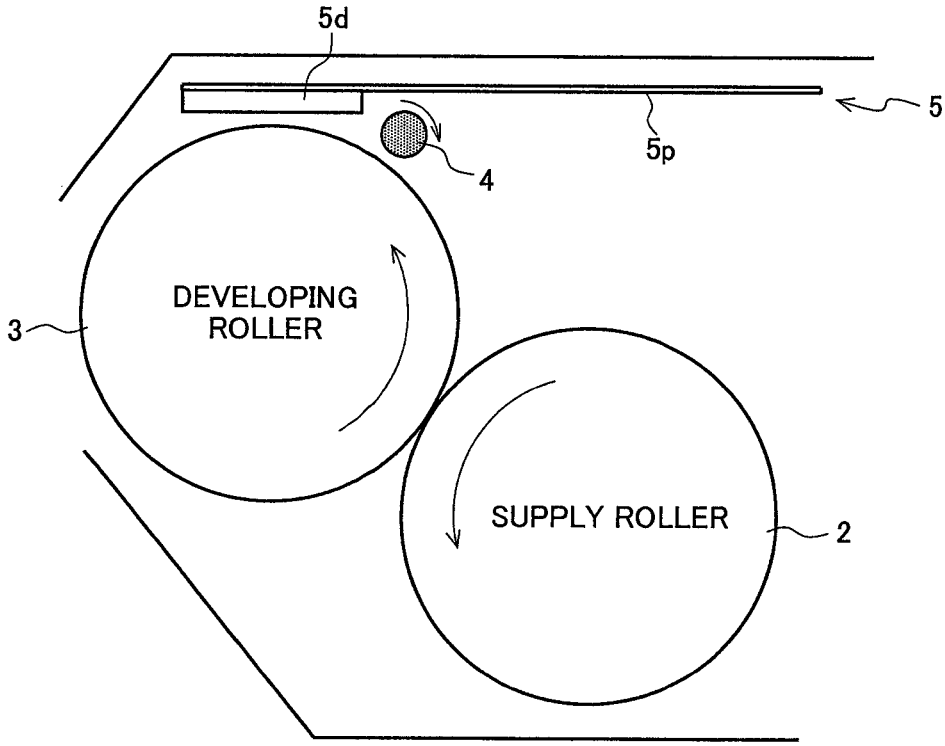
FIG. 12 is a schematic view showing another exemplary configuration of the developing device according to the second embodiment of the present invention.

FIG. 12 is a schematic view configured so as not to divide the elastic body layer of the blade 5 into two areas, that is, configured so as not to employ the exemplary configurations of FIGS. 2 to 7 in the developing device according to the second embodiment of the present invention. As shown in FIG. 12, even when one elastic body layer 5*d* is provided without dividing adhesion of the blade between the upstream part and the downstream part, the effect is exerted by arranging the auxiliary rotatable member 4 or the auxiliary rotatable member 8.

As described above, according to the developing device employing single-component development according to the present invention, toner aggregation is made difficult to occur between the developing roller and the blade in the upstream side of the most proximate area of the developing roller and the blade for regulating the toner layer, and uniformity of the toner layer on the developing roller is increased, so as to be able to perform development which does not apply heavy stress and is excellent in uniformity.

The invention claimed is:

1. A developing device employing single-component development having a developing roller and a blade for regulating a toner layer, applying a bias voltage to the developing roller and developing an electrostatic latent image formed on an electrostatic latent image carrier using a toner, wherein the blade is divided into two areas of a downstream area in a rotational direction of the developing roller including a most proximate part to the developing roller and an upstream area in a rotational direction of the developing roller not including the most proximate part, and adhesion between a toner and the blade in the upstream area is made smaller than that in the downstream area, an auxiliary rotatable member is arranged at a position proximate to the developing roller between a part where the developing roller is proximate to the blade and a part where the developing roller contacts with a supply roller for supplying a toner to the developing roller, so that the auxiliary rotatable member rotates in an opposite direction from the developing roller, and surface roughness of the auxiliary rotatable member is larger than that of the upstream area of the blade.

2. The developing device as defined in claim 1, wherein the blade has higher hydrophilicity on a surface of the upstream area than that of a surface of the downstream area so that adhesion between the toner and the blade in the upstream area is made smaller than that in the downstream area.

3. The developing device as defined in claim 2, wherein the blade uses a same material for the upstream area and the downstream area, and differentiates a surface treatment between the upstream area and the downstream area to differentiate hydrophilicity.

4. The developing device as defined in claim 3, wherein the blade is subjected to a plasma surface treatment with the downstream area masked to differentiate hydrophilicity of the only upstream area.

5. The developing device as defined in claim 3, wherein the blade is subjected to a corona discharge treatment with the downstream area masked to differentiate hydrophilicity of the only upstream area.

6. The developing device as defined in claim 3, wherein the blade irradiates only the upstream area with excimer laser light to differentiate hydrophilicity of the only upstream area.

7. The developing device as defined in claim 2, wherein the blade uses a material having different hydrophilicity for the upstream area and the downstream area so that the upstream area has higher hydrophilicity.

8. The developing device as defined in claim 1, wherein the blade has smaller surface roughness in the upstream area than that in the downstream area, so that adhesion between the toner and the blade in the upstream area is made smaller than that in the downstream area.

9. The developing device as defined in claim 1, wherein the blade has larger thickness in the upstream area than that in the downstream area.

10. The developing device as defined in claim 1, wherein the auxiliary rotatable member is a metal roller.

11. The developing device as defined in claim 1, wherein a groove is formed on a surface of the auxiliary rotatable member.

12. The developing device as defined in claim 1, wherein the auxiliary rotatable member has a plurality of blades vertical to a rotational axis.

13. An image forming apparatus provided with the developing device as defined in claim 1.

14. A developing device employing single-component development having a developing roller and a blade for regulating a toner layer, applying a bias voltage to the developing roller and developing an electrostatic latent image formed on an electrostatic latent image carrier using a toner, wherein the blade is divided into two areas of a downstream area in a rotational direction of the developing roller including a most proximate part to the developing roller and an upstream area in a rotational direction of the developing roller not including the most proximate part, and adhesion between a toner and the blade in the upstream area is made smaller than that in the downstream area, an auxiliary rotatable member is arranged at a position proximate to the developing roller between a part where the developing roller is proximate to the blade and a part where the developing roller contacts with a supply roller for supplying a toner to the developing roller, so that the auxiliary rotatable member rotates in an opposite direction from the developing roller, and when a developing step is finished, the auxiliary rotatable member stops after a certain period of time after the developing roller stops.

15. The developing device as defined in claim 14, wherein the blade has higher hydrophilicity on a surface of the upstream area than that of a surface of the downstream area so that adhesion between the toner and the blade in the upstream area is made smaller than that in the downstream area.

16. The developing device as defined in claim 15, wherein the blade uses a same material for the upstream area and the downstream area, and differentiates a surface treatment between the upstream area and the downstream area to differentiate hydrophilicity.

17. The developing device as defined in claim 16, wherein the blade is subjected to a plasma surface treatment with the downstream area masked to differentiate hydrophilicity of the only upstream area.

18. The developing device as defined in claim 16, wherein the blade is subjected to a corona discharge treatment with the downstream area masked to differentiate hydrophilicity of the only upstream area.

19. The developing device as defined in claim 16, wherein the blade irradiates only the upstream area with excimer laser light to differentiate hydrophilicity of the only upstream area.

20. The developing device as defined in claim 15, wherein the blade uses a material having different hydrophilicity for the upstream area and the downstream area so that the upstream area has higher hydrophilicity.

* * * * *